US006920727B2

(12) United States Patent
Yu et al.

(10) Patent No.: US 6,920,727 B2
(45) Date of Patent: Jul. 26, 2005

(54) WALL PANEL ARRANGEMENT WITH ACCESSORY-SUPPORTING TOP CAP

(75) Inventors: X. Shawn Yu, Hudsonville, MI (US); Steven A. Heyer, Jenison, MI (US)

(73) Assignee: Haworth, Inc., Holland, MI (US)

( * ) Notice: Subject to any disclaimer, the term of this patent is extended or adjusted under 35 U.S.C. 154(b) by 462 days.

(21) Appl. No.: 09/782,947

(22) Filed: Feb. 14, 2001

(65) Prior Publication Data

US 2002/0108330 A1 Aug. 15, 2002

(51) Int. Cl.[7] ..... E04H 1/02; E04H 1/12

(52) U.S. Cl. ..... 52/239; 52/238.1; 52/36.4; 52/36.6; 52/241; 403/363

(58) Field of Search ..... 52/238.1, 236, 52/36.4, 36.5, 36.6, 584.1, 220, 7, 241; 160/135, 351; 362/127, 145; 403/363, 403

(56) References Cited

U.S. PATENT DOCUMENTS

| | | | | | |
|---|---|---|---|---|---|
| 3,592,289 | A | | 7/1971 | Aysta et al. | |
| 3,803,787 | A | * | 4/1974 | Daggy | 52/241 |
| 3,807,102 | A | | 4/1974 | Albinson et al. | |
| 4,068,700 | A | * | 1/1978 | Legler | 160/351 |
| 4,224,769 | A | * | 9/1980 | Ball et al. | 52/36 |
| 4,404,776 | A | | 9/1983 | Ball et al. | |
| 4,433,630 | A | | 2/1984 | Laborie | |
| 4,446,663 | A | | 5/1984 | Stumpf et al. | |
| 4,535,577 | A | | 8/1985 | Tenser et al. | |
| 4,567,698 | A | * | 2/1986 | Morrison | 52/481 |
| 4,571,906 | A | | 2/1986 | Ashton | |
| 4,631,881 | A | * | 12/1986 | Charman | 52/220.7 |
| 4,771,583 | A | | 9/1988 | Ball et al. | |
| 4,821,477 | A | * | 4/1989 | Rydqvist | 52/239 |
| 4,831,791 | A | | 5/1989 | Ball | |
| 4,833,848 | A | * | 5/1989 | Guerin | 52/242 |
| 5,056,577 | A | * | 10/1991 | DeLong et al. | 160/135 |
| 5,094,053 | A | * | 3/1992 | Militzer | 52/238.1 |
| 5,155,955 | A | | 10/1992 | Ball et al. | |
| 5,175,969 | A | * | 1/1993 | Knauf et al. | 52/239 |
| 5,524,402 | A | * | 6/1996 | Sykes | 52/243.1 |
| 5,560,418 | A | * | 10/1996 | Kissinger | 160/351 |
| 5,682,719 | A | * | 11/1997 | Huang | 52/775 |
| 5,806,258 | A | * | 9/1998 | Miedema et al. | 52/220.7 |
| 5,852,904 | A | * | 12/1998 | Yu et al. | 52/220.7 |
| 5,875,596 | A | * | 3/1999 | Muller | 52/239 |
| 5,884,424 | A | | 3/1999 | Smith | |
| 6,112,485 | A | | 9/2000 | Beyer et al. | |
| 6,167,664 | B1 | | 1/2001 | Reuter et al. | |
| 6,272,803 | B1 | * | 8/2001 | Stachowiak et al. | 52/239 |
| 6,293,328 | B1 | | 9/2001 | Fremont | |
| 6,418,671 | B1 | * | 7/2002 | DeRuiter et al. | 52/36.4 |

FOREIGN PATENT DOCUMENTS

| | | | | |
|---|---|---|---|---|
| CA | 2 075 014 | | 2/1993 | |
| DE | 1188259 | * | 9/1957 | 52/239 |
| GB | 2096379 | * | 4/1982 | 52/238.1 |

* cited by examiner

*Primary Examiner*—Lanna Mai
*Assistant Examiner*—Phi Dieu Tran A.
(74) *Attorney, Agent, or Firm*—Flynn, Thiel, Boutell & Tanis, P.C.

(57) ABSTRACT

A space-dividing wall panel arrangement having a plurality of upright wall panels serially connected one with the other by an upright support post. The wall panel arrangement additionally includes an open-frame structure which allows routing of cabling therethrough to provide power and communication capabilities to a workstation defined by the wall panels, and a removable and rigid top cap which is capable of supporting various furniture-type accessories at selected locations along the longitudinal extent of the panel arrangement, and which also permits mounting of return wall panels to permit greater flexibility in configuring a workstation.

37 Claims, 9 Drawing Sheets

180
182
186
189
189
188
187
181

161
193
190
191
192
186
154
155
161
171
76
67
72
73
13
76
75
172
168
170
169
70
81
75
40
22
81
73
183
182
180
175
188
194
196
162
167
161
159
158
156
154
157
158
155
161
162
163
164
165
160
165
92
93
94
83
84
86
40
22
86
85
84
91
90

WALL PANEL ARRANGEMENT WITH ACCESSORY-SUPPORTING TOP CAP

FIELD OF THE INVENTION

This invention relates to a wall panel arrangement formed from upright serially-connected panels joined together by intermediate support posts, and more specifically, to a wall panel arrangement including a top cap which mounts thereon components such as shelves, cabinets and the like.

BACKGROUND OF THE INVENTION

Commercial buildings typically include large open office areas which are divided into smaller work spaces or workstations by any of a number of panel systems that have been developed therefor. These panel systems typically employ upright space-dividing wall panels which serially connect together through two panel straight or angled connections, or through suitable three or four panel connections, to subdivide the office area into a plurality of smaller workstations of desired size and configuration. Such panels are typically less than floor-to-ceiling height, and cooperate with other furniture components to define an equipped workstation. These components may include worksurfaces, file cabinets, shelf units and the like which mount directly on and are supported by the wall panels, and may also include freestanding furniture components such as tables, chairs and file cabinets.

In the known arrangements of panel systems, the individual panel assemblies have a variety of configurations. For example, in some arrangements, the individual panels are themselves supported directly in load-bearing relationship with a floor by support feet or glides. In other arrangements, serially-adjacent panel assemblies are interconnected through intermediate upright support posts or poles which bear the weight of the panels and in turn are maintained in load-bearing engagement with the floor. The present invention is an improved panel arrangement particularly suited for use in the latter-mentioned post-type arrangement having intermediate upright support posts, but may also be utilized with the former arrangement wherein the panel assemblies are themselves supported directly on the floor.

Since it is often desirable to attach shelves, cabinets and other office-type accessories to the panels, the upright support posts are typically provided with vertically-oriented rows of apertures, which can be used to mount hook-type supporting brackets attached to the shelves or other components. As the support posts are arranged in sidewardly-spaced relation from one another on respective opposite ends of a panel, a component which is to be mounted to a panel must typically have a width dimension which substantially corresponds to the horizontal distance between the support posts to enable engagement of the brackets with the apertures defined in the posts. This construction necessarily places restrictions on the configuration of the workstation, and particularly the mounting locations of the components on the panels.

In the arrangement disclosed in U.S. Pat. No. 4,821,477, an upright wall is formed by stackable panel sections each having upper and lower elongate frame members. The upper and lower frame members each define therein an outwardly opening and longitudinally extending groove. The groove in the upper frame member accommodates an upper end of a bracket associated with a shelf or other office-type accessory. This arrangement permits mounting of components at multiple locations along the wall panel, simply by sliding the bracket and the associated accessory longitudinally along the wall panel to the desired location. The mounting of components in this manner is thus not dependent upon the location of the adjacent pairs of support posts, and thus allows greater freedom in arranging a workstation.

The above arrangement, however, includes prefabricated, factory-assembled, one-piece panel sections or modules with the upper and lower groove-defining frame members provided integrally therewith. This construction, for example in comparison with a panel assembly having an open frame construction on which cover panels are attached, is limited in terms of flexibility in arranging a workstation and also in terms of load-bearing capability. In addition, the solid modular panel sections are incapable of interiorly accommodating electrical components and cabling for providing power and/or communication capabilities to the workstation.

The present invention relates to a post-type space-dividing wall panel system having a plurality of base panels which are serially connected to one another to define an upright wall. Each pair of adjacent base panels are connected to one another by an upright support post positioned in load-bearing relationship with the floor. To adjust the height of the wall panel, an appropriate number of horizontal cross rails or frame members are connected between a spaced-apart pair of support posts above the respective base panel. Thus, the pair of adjacent support posts, the cross member and the upper edge of the base panel together define an open interior which can be used to accommodate power distribution assemblies and cabling. Further, mounting members are provided for mounting cover pads or panels in overlying engagement with the outside faces of the base panel and the open areas above each base panel so as to define an upright, space-dividing wall panel.

As discussed above, office-type accessories or components, such as cabinets, shelves and the like are often mounted to a respective wall panel with hook-type brackets which engage in the apertures defined in adjacent pairs of support posts. However, it is often desirable or necessary to mount such components at locations which do not coincide with the support posts, or to mount components which do not have a width which corresponds to the distance defined between an adjacent pair of support posts. As such, the present invention includes a top cap member which defines the uppermost extent of a respective panel assembly and which is configured to mount components thereon. More specifically, the top cap member according to the invention includes an upwardly-opening groove therein which accommodates an upper hook-shaped end of a hanger or bracket fixed to an office-type accessory. The groove extends along the entire length of the wall panel, and the grooves of serially-adjacent top cap members of serially adjacent and aligned wall panels together form a continuous groove which extends longitudinally along essentially the entire length of an aligned panel run. This arrangement permits continuous, uninterrupted sliding or adjustment of furniture components along the entire length of the aligned channels.

The top cap member according to the invention is of a rigid construction, and is supported on and clamped to the uppermost cross rail of a panel assembly. Further, the accessory-mounting brackets cooperate with the top cap member, and are also engaged with a lower frame component. This arrangement provides significant load-bearing capabilities, so as to permit mounting of shelving and the like. In addition, the top cap member can be utilized to mount a support post in a position intermediate the opposite vertical side edges of a respective panel assembly. A wall panel or return wall can then be mounted to the intermediate support post so as to create a T-shaped panel configuration, for example, which provides greater flexibility in configuring a workstation.

Other objects and purposes of the invention, and variations thereof, will be apparent upon reading the following specification and inspecting the accompanying drawings.

Figure 1:
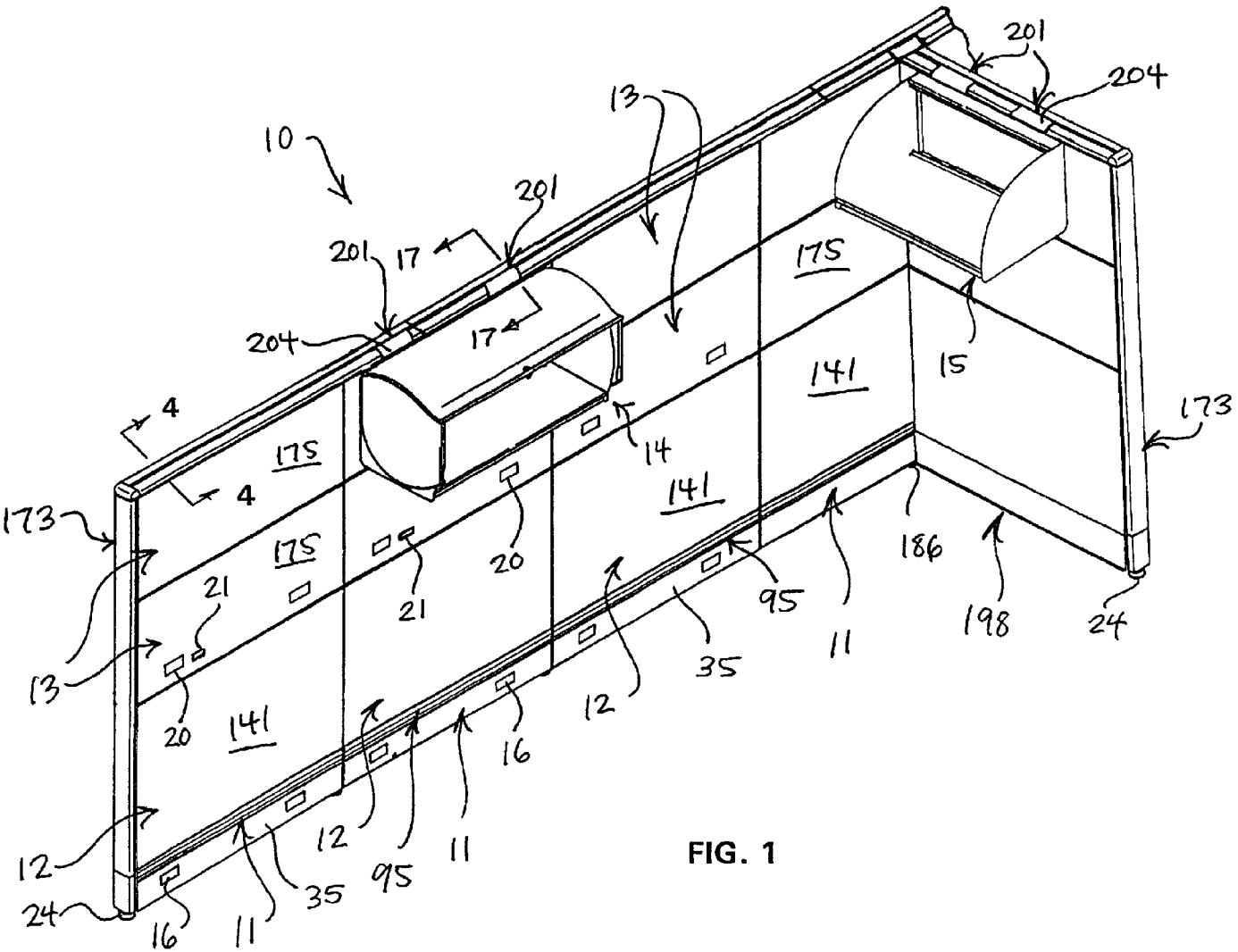
FIG. 1 is a perspective view illustrating a wall panel arrangement according to the invention.

Certain terminology will be used in the following description for convenience in reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the arrangement and designated parts thereof. Said terminology will include the words specifically mentioned, derivatives thereof, and words of similar import.

DETAILED DESCRIPTION

Figure 2:
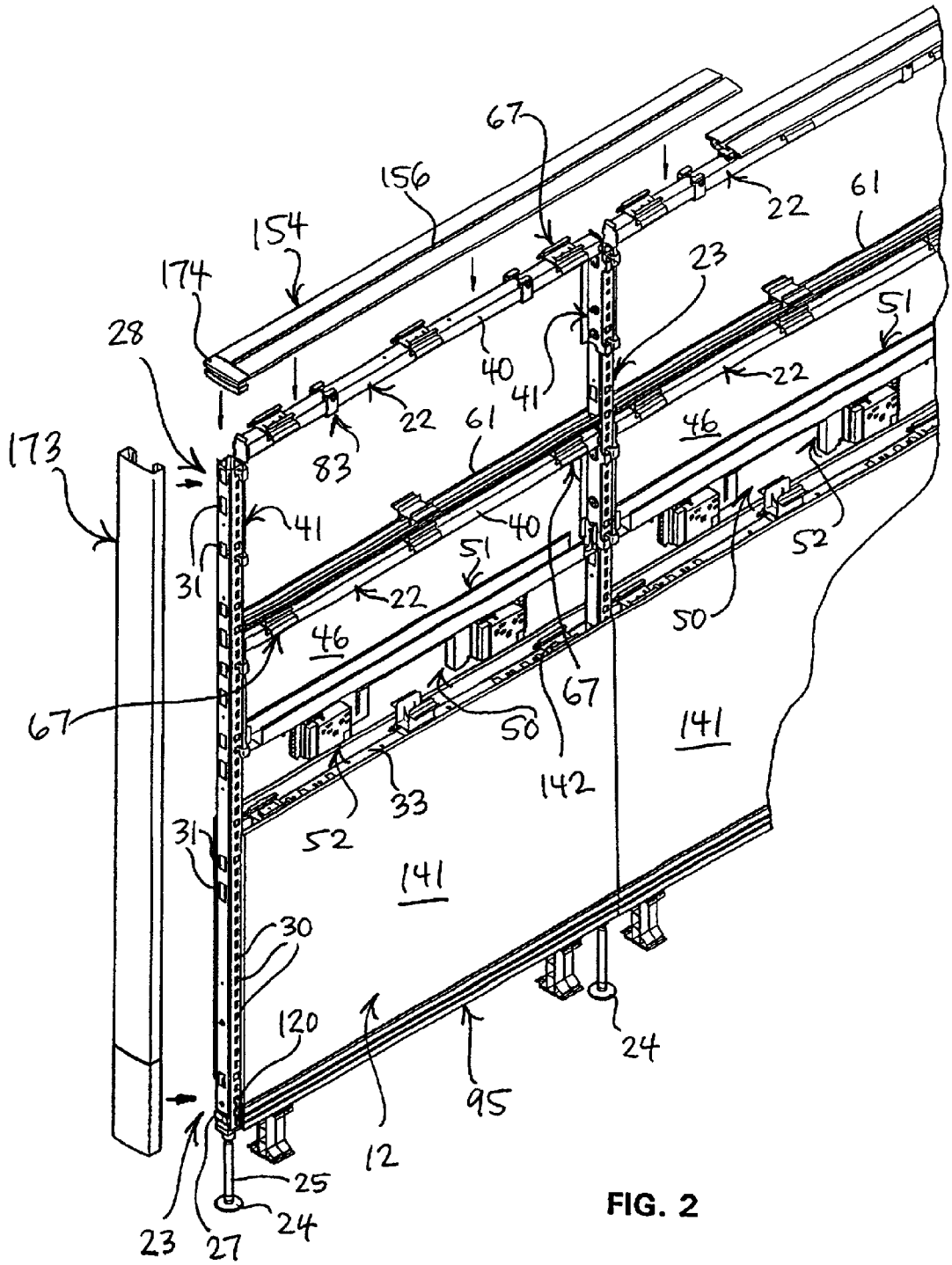
FIG. 2 is a partially exploded, fragmentary, perspective view of a pair of serially adjacent wall panel assemblies of FIG. 1 without upper cover pads.
Figure 3:
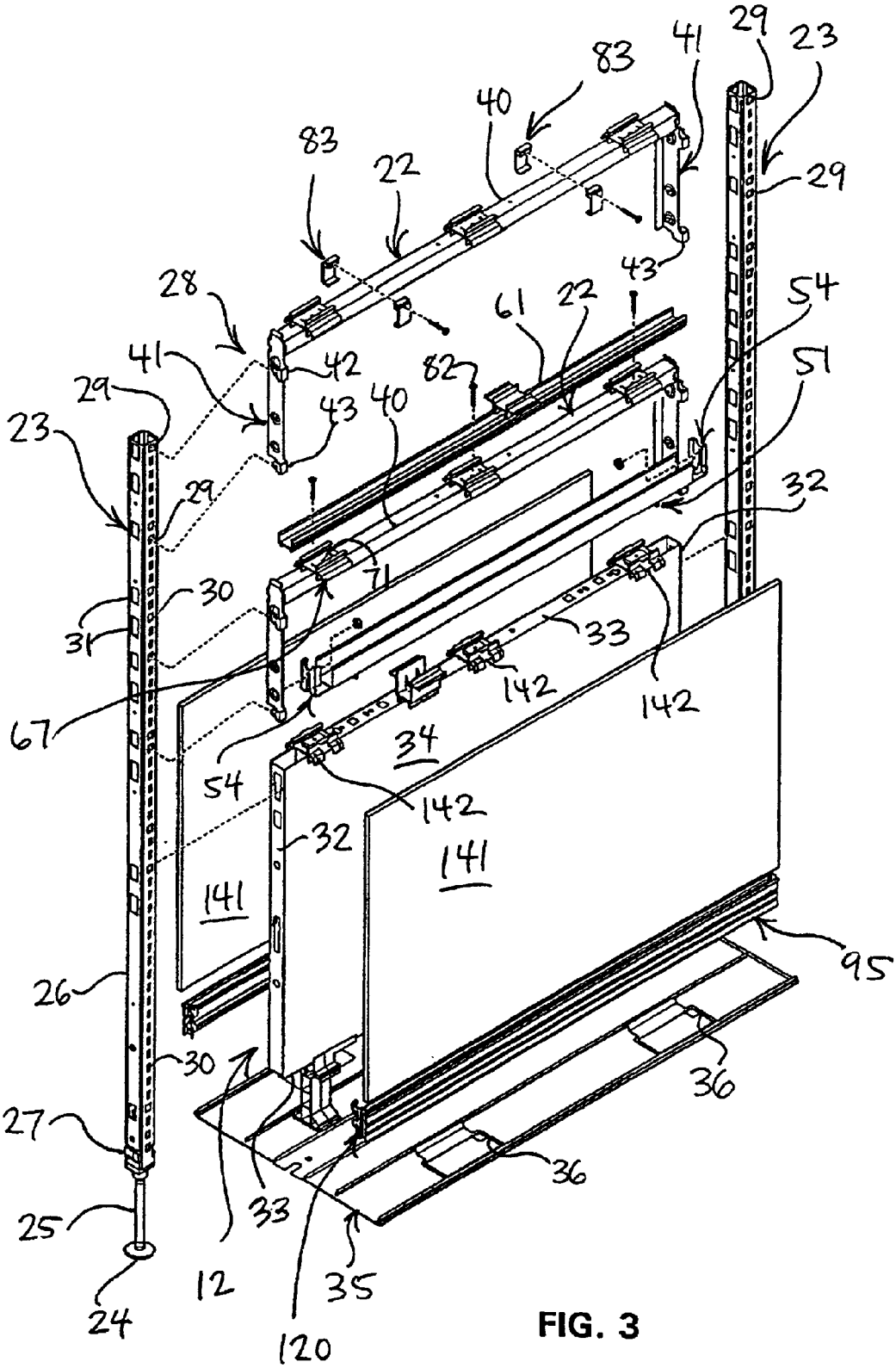
FIG. 3 is an exploded perspective view of one wall panel assembly.

Referring to FIGS. 1–3, the invention relates to a wall panel arrangement 10 which includes a selected number of upright wall panel assemblies 11 serially connected, for example, in two-panel straight or angled, or three- or four-panel corner configurations so as to subdivide an office area into separate workstations. In the illustrated embodiment, each wall panel assembly 11 includes a base panel assembly 12 supported on a floor and typically includes one or more upper panel assemblies 13 positioned vertically one above the other in a vertical plane.

Generally, a workstation is defined by a selected arrangement of the base panel assemblies 12 which are serially connected to one another to form at least a lower section of a vertically extending wall. Besides selectively subdividing the office area by the placement of the base panel assemblies 12, the wall panel arrangement 10 permits adjustment of the wall height by selective placement of one or more upper panel assemblies 13 vertically on each base panel assembly 12. The wall panel assemblies 11 support office components such as a cabinet 14, shelf unit 15, worksurfaces (not shown) or other conventional furniture components, while additional freestanding components (not shown) such as chairs and cabinets can be positioned within the workstation. To accommodate additional workstation equipment such as telephones, computers, facsimile machines and the like, the wall panel assemblies 11 also selectively include electrical receptacles 16 at a base raceway height, additional electrical receptacles 20 at a beltline height (for example, above a typical worksurface) and further communication receptacles 21 for connection to modems or telephones.

The individual wall panel assemblies 11 have an open frame structure 28 (FIGS. 2 and 3) including a pair of upright support posts 23 arranged on either side of each panel assembly 11 and one or more cross members 22 which extend laterally between each pair of support posts 23. A plurality of wall panel assemblies 11 (as shown in FIG. 1) are serially connected in an end-to-end aligned relationship to one another, wherein each serially adjacent pair of the wall panel assemblies 11 are connected together by a common upright support post 23. Thus, each panel assembly 11 extends laterally and is supported at its opposite ends by two spaced-apart posts 23, with an intermediate one of the support posts 23 being connected between a pair of the panel assemblies 11.

As briefly discussed above, the wall panel assembly 11 includes the base panel assembly 12 and may also include a selected number of upper panel assemblies 13. In the illustrated embodiment, each support post 23 is vertically elongate and has a disc-like glide 24 in supportive engagement with the floor. The glide 24 threadingly engages an extension rod 25 which is of conventional construction for leveling the wall panel assemblies 11. The upper end of extension rod 25 is fixed to a lower end of a square tubular section 26 which substantially defines the overall vertical length of the support post 23. The lowermost end of the tubular section 26 mounts thereon a pair of outwardly and upwardly projecting connector hooks 27.

To permit connection of furniture components or accessories to the support posts 23 on oppositely facing sides of each wall panel assembly 11, each support post 23 includes a plurality of generally rectangular apertures 30. The apertures 30 are formed in oppositely facing sides of the support post 23 and are vertically spaced along the longitudinal length thereof. The apertures 30 accommodate hook-like projections on furniture component support brackets (not shown). This vertically-spaced arrangement of apertures 30 and hook-like projections is a conventional mounting arrangement used in wall panel systems and thus a more detailed description is believed unnecessary.

To connect the base panel assemblies 12 to the support post 23, the support post 23 also includes a plurality of generally rectangular openings 31 located in opposite outwardly facing sides of the support post 23 (i.e. on the sides of support post 23 unoccupied by apertures 30 and on the same sides as connector hooks 27). The base panel assemblies 12 are fixed to the respective support posts 23 via panel locks which cooperate with openings 31 and via the connector hooks 27 formed at the lower end of support post 23. This panel-lock connection is disclosed in U.S. Pat. No. 6,112,485, which patent is owned by the same Assignee hereof and is incorporated herein by reference in its entirety.

The base panel assembly 12 which connects to the support post 23 is disclosed in U.S. Pat. No. 5,806,258 (owned by the same Assignee hereof and hereby incorporated by reference herein), and therefore will be only briefly discussed here. The base panel assembly 12 has a frame formed from two elongate vertical rails 32 which define laterally spaced-apart ends of the assembly 12, and two elongate horizontal rails 33 which define upper and lower base panel edges that extend laterally between the opposite panel ends. The rails 32 and 33 are joined with planar metal skins or surfaces 34 which define opposite outwardly facing side surfaces thereof. The vertical rails 32 are generally hollow and are adapted to receive therein a panel lock (not shown) for attaching the base panel assembly 12 to the respective support post 23 in a manner disclosed in the above-mentioned '485 patent.

When connected to the support posts 23, the base panel assembly 12 is spaced vertically above the floor so as to define a horizontally elongate space therebetween which accommodates a raceway assembly (not shown), including a power distribution assembly or "PDA" for carrying electrical power. The PDA is a commercially available product sold by the Assignee hereof for the PREMISE wall panel system, and thus a more detailed discussion thereof is not believed necessary. The PDA in conjunction with a raceway assembly is also discussed in detail in the '258 patent. Power can be distributed at base height where needed, for example, by connecting a receptacle 16 to a power block of the PDA and then enclosing the raceway assemblies with appropriate raceway covers 35 formed with receptacle ports 36 therethrough (FIG. 3).

The height of an individual wall panel assembly 11 in the illustrated embodiment is determined by the vertical height of the adjacent pair of support posts 23. These support posts 23 are manufactured in predetermined lengths, so that the appropriate-length post 23 can be utilized based upon the desired height of the wall panel assembly 11. Alternatively, a pair of lower support posts can be attached to opposite sides of each base panel assembly, and extension posts can then be attached to upper ends of the lower posts with a bayonet-type connection so that the height of each panel assembly is determined by the number of extension panel assemblies stacked atop the respective base panel assembly. This type of arrangement is disclosed in the '258 patent.

Once the base panel assemblies 12 are connected to the respective support posts 23 such that a workstation is defined thereby, the wall panel assembly 11 is extended further upwardly by installing the appropriate number of cross members 22. In the illustrated embodiment, two cross members 22 are provided on each wall panel assembly 11 in vertically-spaced relation with one another. The cross members 22 and the assembly thereof to the respective support posts 23 are described in detail in co-pending application Ser. No. 09/326 192 entitled "FRAME ARRANGEMENT FOR A WALL PANEL SYSTEM" (owned by the same Assignee hereof), and will therefore be only briefly discussed below.

Each cross member 22 includes a rigid tubular section 40 and a pair of downwardly extending and elongate connector brackets 41 joined to opposite ends thereof. The connector brackets 41 have a generally L-shaped transverse cross-section, and mount thereon upper and lower hook plates 42 and 43 which are vertically spaced from one another. The cross member 22 is assembled to the support posts 23 by inserting the upper hook plates 42 of the respective connector brackets 41 into enlarged ones 29 of the apertures 30 of the respective posts 23 with the cross member 22 in a tilted position relative to posts 23, and then pivoting the lower end of cross member 22 toward posts 23 to align the lower hook plates 43 with corresponding lower enlarged apertures 29. Once the lower hook plates 43 are engaged within the lower enlarged apertures 29, the entire cross member 22 is then lowered so as to fix hook plates 42 and 43 within the respective apertures 29.

Once assembled, the cross member 22 and the respective support posts 23 define a downwardly-opening U-shaped frame which constitutes the frame of each upper panel assembly 13. One or more cross members 22 can then be added vertically in the same manner (depending upon the height of posts 23) and in particular, additional U-shaped frames can be formed vertically atop the other. When two upper panel assemblies 13 are formed serially adjacent to each other, the cross members 22 are each connected to an intermediate one of the support posts 23 which is disposed therebetween. With the cross member 22 assembled to the support posts 23, an open interior 46 is defined by the support posts 23, the cross member 22, and the upper base panel rail 33, which open interior 46 generally defines a beltline raceway 50.

With reference to FIGS. 2 and 3, an elongate and generally U-shaped cable trough 51 is illustrated which may be utilized for supporting a PDA 52 within the beltline raceway 50, and also permits the laying in of cabling, such as communication cabling. This cable trough 51 and the mounting thereof to the cross member 22 is described in detail in the '192 application, and will therefore be only briefly described here. The PDA 52 includes power blocks which are electrically connected with one another, and one or more receptacles 20 are selectively connected to the power blocks. The cable troughs 51 of serially adjacent upper panel assemblies 13 are horizontally aligned to define a continuous trough-like passage whereby cabling can be laid therein and routed over the faces of the support post 23 generally in the manner illustrated in the '258 patent. The trough 51 has a pair of brackets 54 which are fixed to opposite ends thereof, each of which defines therein a downwardly-opening slot.

After the lowermost cross member 22 is assembled onto the support posts 23, the cable trough 51 is mounted on the cross member 22 by positioning trough 51 horizontally between the connector brackets 41, and the trough 51 is then lowered so that studs mounted on lower ends of the respective connector brackets 41 seat within the upper part of the respective slots of brackets 54. Nuts are then tightened on the respective studs to securely and rigidly fasten cable trough 51 on cross member 22.

Figures 17, 18:
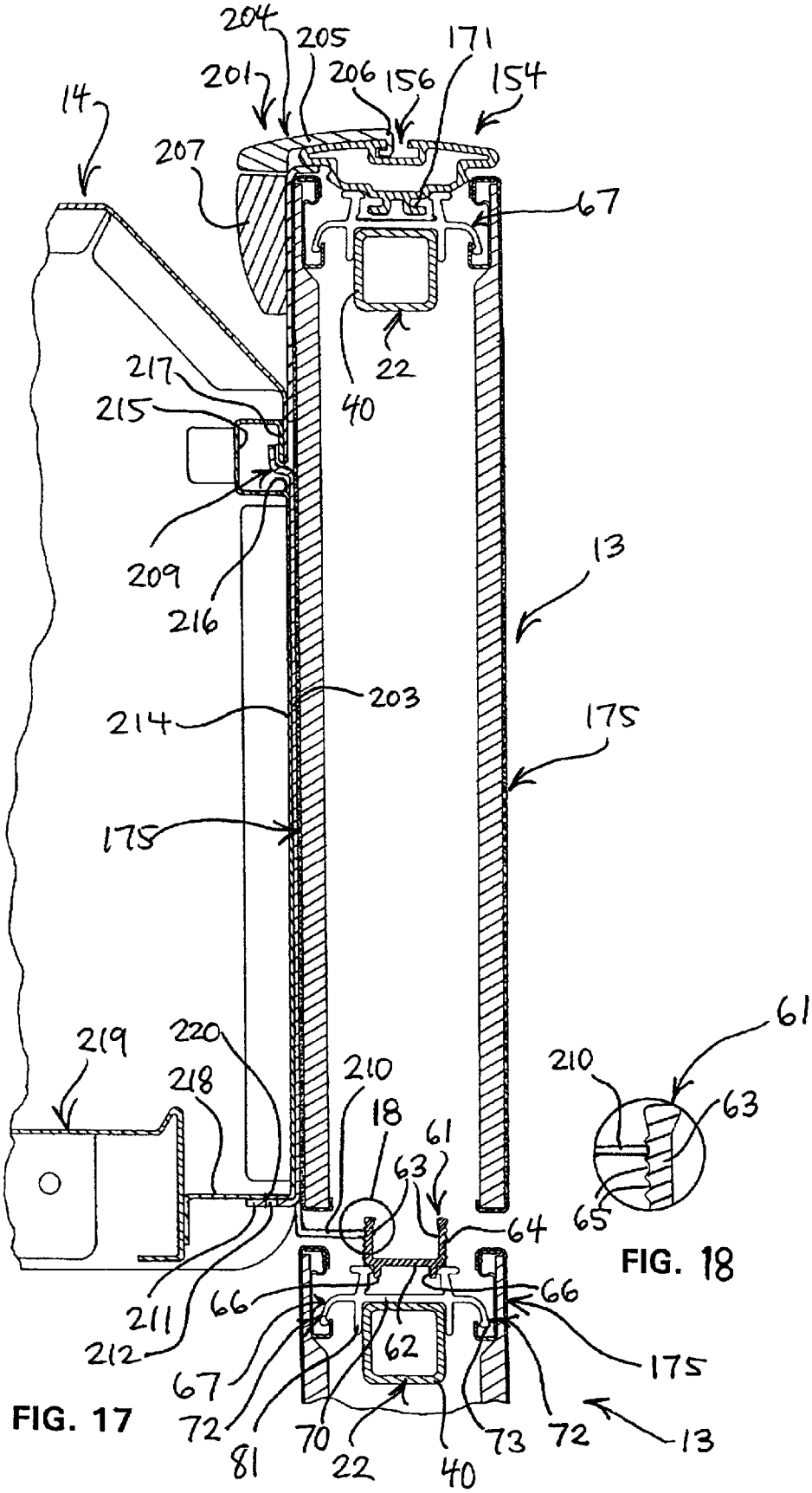
FIG. 17 is an enlarged cross-sectional view illustrating the mounting of an overhead storage cabinet on a wall panel taken generally along line 17—17 in FIG. 1.
FIG. 18 is an enlarged detail view of the cooperation between the support rail and bracket.

Frame structure 28 additionally includes an elongate and horizontally oriented support rail 61. Support rail 61 includes a flat base wall 62 and a pair of upright side walls 63 which project upwardly from respective opposite side edges of base wall 62 to provide support rail 61 with a generally U-shaped transverse cross-section (FIG. 17). The outwardly facing sides of the respective side walls 63 each have an outer surface 64 with an undulating profile. More specifically, each outer surface 64 defines therein a plurality of horizontally extending and elongate grooves 65 (FIG. 18) which open sidewardly and are vertically-spaced from one another along the respective outer surface 64. The grooves 65 extend continuously along the entire horizontal extent of support rail 61. Support rail 61 additionally includes a pair of elongate lower ribs 66 which are spaced slightly inwardly from the respective side edges of base wall 62 and are cantilevered downwardly therefrom in generally parallel relation with one another. In the illustrated embodiment, ribs 66 extend along the entire horizontal extent of rail 61.

Support rail 61, as shown in FIGS. 2, 3 and 17, is mounted atop the lower cross member 22. In this regard, lower cross member 22 mounts thereon a plurality of rigid pad brackets 67. Upper cross member 22 also mounts a plurality of the brackets 67 thereon as discussed further below. Pad brackets 67 are identical to one another and therefore only one of which will be discussed in detail herein. Pad bracket 67 includes a flat and generally horizontally oriented base wall 70 which defines a generally centrally located through hole 71 therein. A pair of flanges 72 are joined to respective side edges of base wall 70. Each flange 72 first projects horizontally sidewardly from the respective side edge of base wall 70, and then bends or curves downwardly and terminates in a lower free edge 73. A pair of upper walls 75 are joined to and project upwardly from base wall 70 (see FIGS. 12 and 17), and are spaced horizontally inwardly from the lower free edges 73 of the respective flanges 72. Upper walls 75 angle slightly inwardly toward one another, and terminate at free upper ends defined by respective elongate support flanges 76 which extend along the entire horizontal extent of the respective walls 75. Each support flange 76 projects horizontally beyond the outwardly facing surface of the respective upper wall 75, and each defines a generally flat and horizontally oriented upper support surface.

A pair of vertically oriented lower walls 81 are joined to and project downwardly from a lower surface of base wall 70. Lower walls 81 are generally parallel to one another and terminate at lower free ends which are spaced slightly downwardly from the lower free edges 73 of flanges 72. Further, the lower walls 81 are generally vertically aligned with the respective upper walls 75. In the illustrated embodiment, the support rail 61 as well as the pad brackets 67 are constructed of metal, and are formed by extrusion.

Each pad bracket 67 is mounted on lower cross member 22 by placing the lower surface of base wall 70 on the upper surface of cross member 22, so that the lower walls 81 overlie the respective outer upright side surfaces of cross member 22. The distance as measured transversely between the respective lower walls 81 of bracket 67 is thus slightly greater than the transverse width of cross member 22 so that cross member 22 is capable of being sandwiched between the respective lower walls 81. Additional brackets 67 are mounted on cross member 22 in a similar manner. The support rail 61 is then positioned atop the respective brackets 67 so that the lower ribs 66 engage with, and are positioned between the inner edges of the respective support flanges 76 of pad brackets 67. Fasteners 82 (FIG. 3) are then inserted through corresponding holes in support rail 61, into the holes 71 of the respective brackets 67 and then into the cross member 22 (for example, into pre-drilled holes in cross member 22) to securely fasten support rail 61 to cross member 22.

Uppermost cross member 22 mounts additional pad brackets 67 thereon in a similar manner to that discussed above. That is, upper cross member 22 seats within the channel defined between the respective lower walls 81 of each bracket 67, and a fastener (not shown) is then inserted through the holes 71 in pad brackets 67 and into upper cross member 22. Uppermost cross member 22 additionally mounts thereon a plurality of identical top cap clips 83 (FIG. 4), only one of which will be described in detail herein.

Top cap clip 83 includes a pair of identical and opposed clamp members 84 which clampingly engage the sides of the upper cross member 22. Each clamp member 84 includes an upright side wall 85 which at the lower end thereof defines an inwardly projecting flange 86 which is generally horizontally oriented and perpendicular to side wall 85. The upper end of side wall 85 includes upper and lower horizontal legs 90 and 91 which project inwardly in a generally parallel manner with lower flange 86. Upper and lower legs 90 and 91 are vertically spaced from one another so as to define a sidewardly and inwardly opening channel 92 therebetween. A threaded through-hole 93 extends generally horizontally and completely through lower leg 91. Each clamp member 84 is constructed of a rigid material, such as metal, and in the illustrated embodiment is formed by extrusion.

Figures 4, 11, 12:
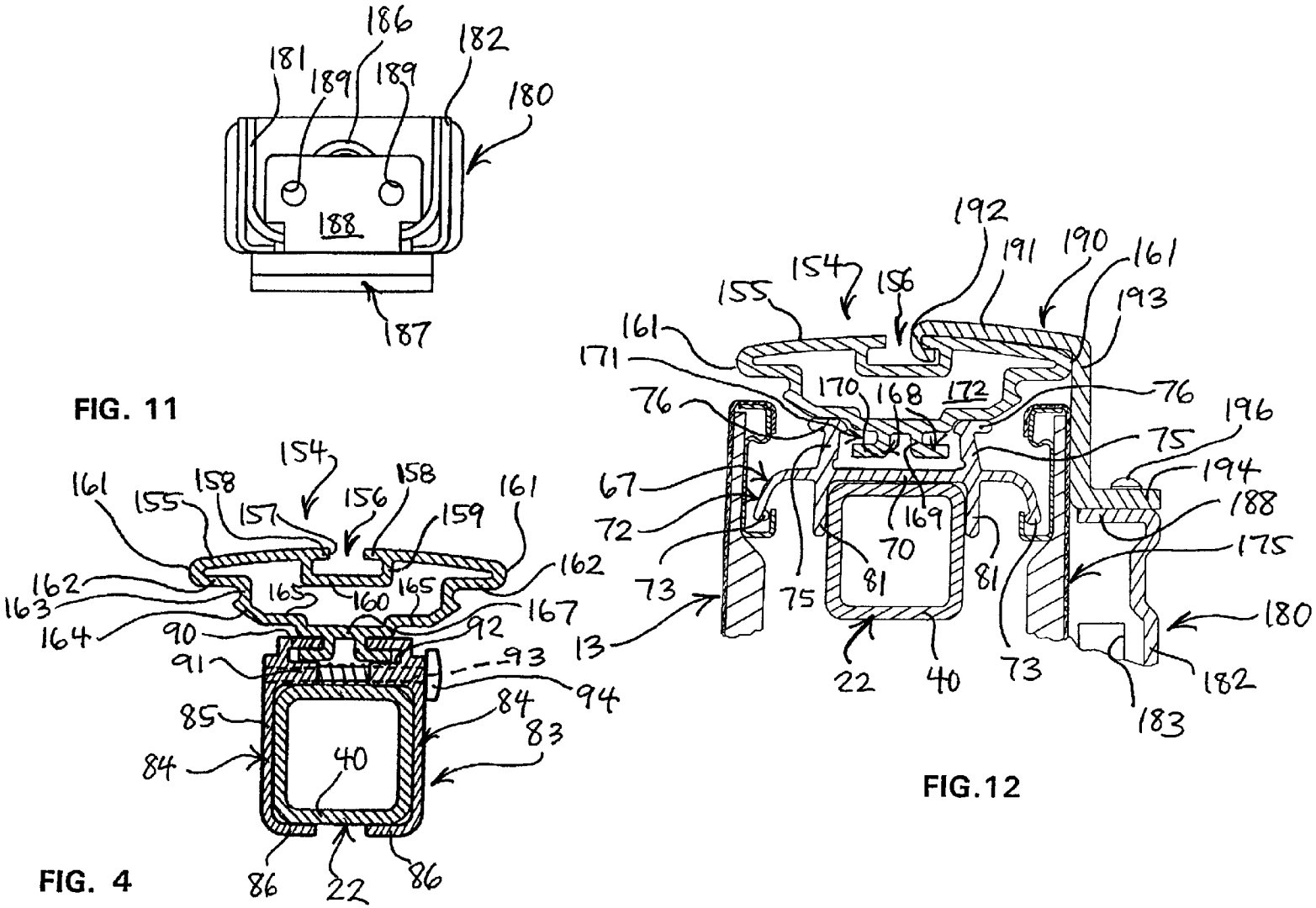
FIG. 4 is an enlarged cross-sectional view of a top cap member and its engagement with an upper cross member taken generally along line 4—4 in FIG. 1.
FIG. 11 is an enlarged top view of the return-wall connector post.
FIG. 12 is an enlarged fragmentary cross-sectional view of the return-wall connector post and top mounting bracket taken generally along line 12—12 in FIG. 8.

The clamp members 84 of each top cap clip 83 are mounted to uppermost cross member 22 by positioning the respective clamp members 84 on opposite sides thereof with the upright side walls 85 positioned so as to overlie the respective outer upright side surfaces of cross member 22, and so that the mouths of the channels 92 of the opposed clamp members 84 are facing one another. As shown in FIG. 4, the vertical distance defined between the lower leg 91 and the lower flange 86 is slightly larger than the vertical dimension of the cross member 22 so that same fits snugly between lower leg 91 and lower flange 86. The respective opposed clamp members 84 are then aligned with one another so as to align the through holes 93 thereof, and a fastener 94 is inserted into the aligned holes 93 and tightened so as to fix the opposed clamp members 84 on cross member 22.

Figure 5:
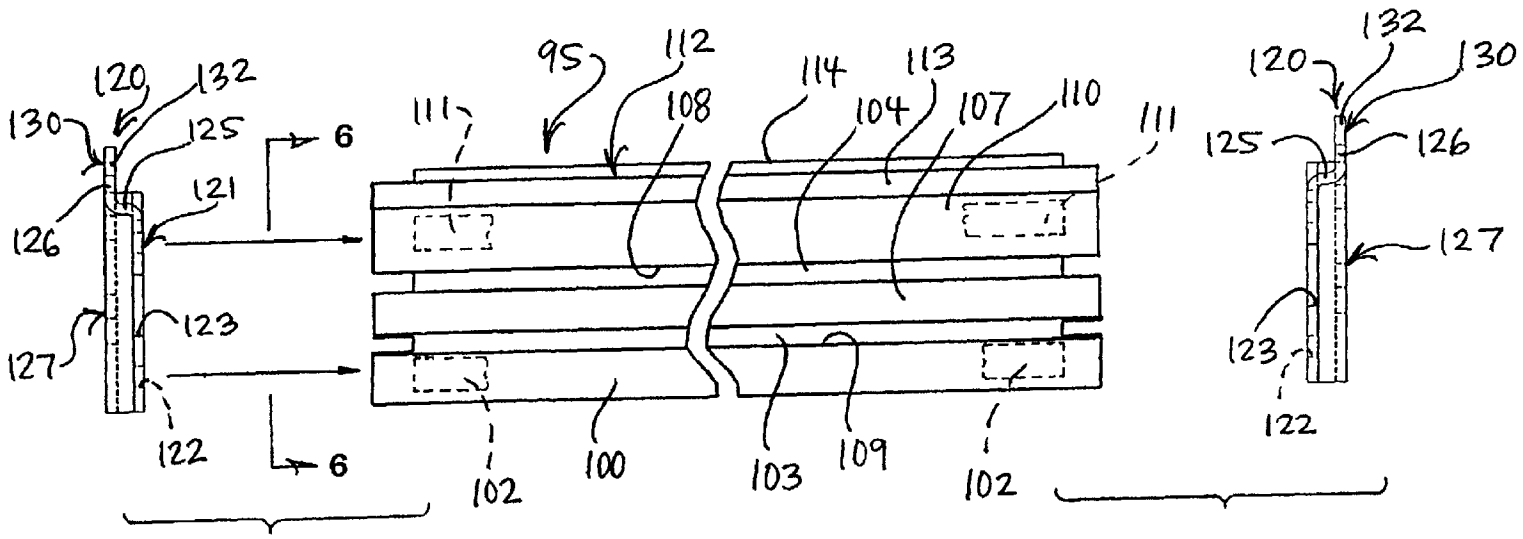
FIG. 5 is an enlarged fragmentary and exploded front view of a lower mounting rail and the mounting brackets associated therewith.
Figure 6:
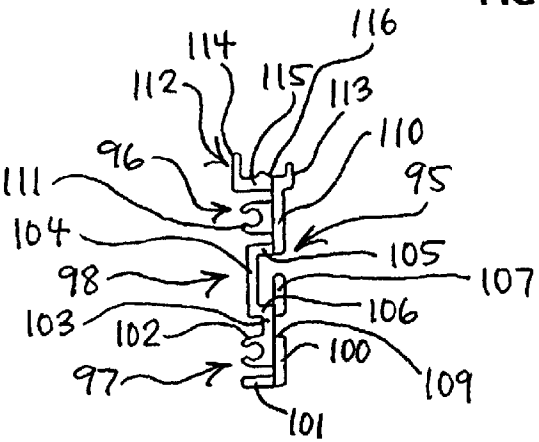
FIG. 6 is an enlarged end view of the mounting rail of FIG. 5 as seen generally along line 6—6 therein.

In the illustrated embodiment, each panel assembly 11 additionally includes a bottom mounting rail 95 as shown in FIGS. 3, 5 and 6. Bottom mounting rail 95 is defined by an upper section 96, a lower section 97 and an intermediate section 98 joined to and disposed between upper and lower sections 96 and 97. Lower section 97 includes an upright wall part 100 which at a lower end thereof is joined to a horizontally oriented bottom leg 101 defining the lowermost extent of mounting rail 95, and a sidewardly-opening mounting boss 102 which projects rearwardly from wall part 100 and extends across the entire lengthwise extent of mounting rail 95. Mounting boss 102 is spaced slightly upwardly from bottom leg 101 and is joined to intermediate section 98 through a wall section 103 which projects upwardly from boss 102.

Intermediate section 98 has a generally C-shaped cross-section defined by a rear wall part 104, top and bottom walls 105 and 106 which are generally parallel to one another, and a front wall part 107 which is parallel to and horizontally spaced from rear wall part 104. The C-shaped cross-section of intermediate section 98 defines a frontwardly-opening and generally L-shaped upper channel 108. Further, front wall part 107 of intermediate section 98 and wall part 100 of lower section 97 along with the front surface of wall section 103 define a frontwardly-opening lower channel 109. Both upper and lower channels 108 and 109 extend continuously along the entire length of mounting rail 95 and each additionally opens sidewardly at opposite ends thereof.

Upper section 96 is defined by an upright wall section 110 which lies in the same vertical plane as front wall part 107 and wall part 100, and is joined to a front edge of top wall 105 of intermediate section 98 and projects upwardly therefrom. A further mounting boss 111 similar to boss 102 projects from a rear side of wall section 110. Upper section 96 additionally includes a trough-like portion 112 which is joined to wall section 110 and defines the uppermost extent of mounting rail 95. Trough-like portion 112 is defined by parallel and upright front and rear flanges 113 and 114 and a horizontal bottom section 115. Front and rear flanges 113 and 114 project vertically upwardly from respective side edges of bottom section 115 and in the illustrated embodiment, the vertical height of front flange 113 is slightly less than the vertical height of rear flange 114. Trough-like portion 112 defines an upwardly-opening channel 116 which extends continuously across the entire lengthwise extent of mounting rail 95.

Figure 7:
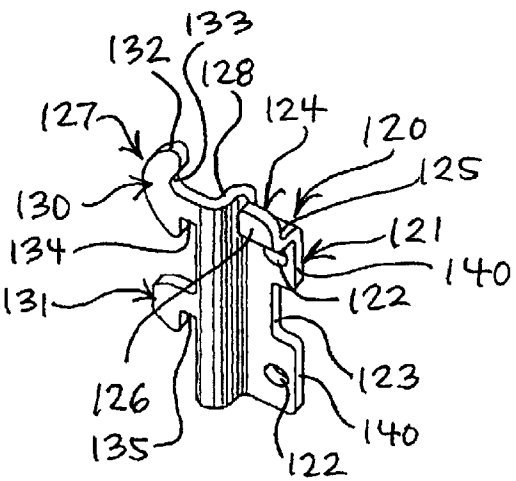
FIG. 7 is an enlarged perspective view of one mounting bracket as shown in FIG. 6.

As shown in FIGS. 3, 5 and 7, mounting rail 95 includes right and left connectors 120 for securing rail 95 to the respective wall panel assembly 11. The right and left connectors 120 are mirror images of one another, and only one of which will therefore be described herein. The connector 120 includes a front plate-like member 121 which defines therein a pair of vertically-spaced mounting holes 122. Plate-like member 121 additionally includes a sidewardly-opening recess 123 disposed approximately midway between mounting holes 122. A corner-shaped pad-supporting flange 124 is joined to plate-like member 121 and is defined by a first leg 125 which is generally horizontally oriented and joined to an upper edge of plate-like member 122, and a second leg 126 which is generally vertically oriented and cantilevered upwardly from an outermost side edge of first leg 125.

Connector 120 additionally includes a rear mounting part 127 which is joined to plate-like member 121 through a curved portion 128 and projects sidewardly from plate-like member 121 first in the direction of flange 124, and then rearwardly in a direction generally parallel to plate-like member 121. A rearmost vertical edge of mounting part 127 includes a pair of hooks 130 and 131 which are vertically spaced from one another and are utilized to attach mounting rail 95 to the respective wall panel assembly 11. The upper hook 130 includes an upwardly projecting member 132 which defines a frontwardly-opening recess 133 and a lower downwardly-opening slot 134. Lower hook 131 also defines a downwardly-opening slot 135 similar to slot 134.

The connectors 120 are fastened to the respective opposite ends of mounting rail 95 as follows. The left connector 120 is positioned adjacent the terminal end of mounting rail 95 so that mounting holes 122 are generally aligned with the respective upper and lower bosses 111 and 102 of rail 95, with the hooks 130 and 131 projecting rearwardly. Fasteners (not shown) are then inserted through the respective holes 122 and into bosses 111 and 102, so that the front plate-like member 121 overlies the sidewardly facing surfaces of bosses 111 and 102. When the connector 120 is mounted on rail 95, the upwardly facing surface of first or bottom leg 125 of flange 124 is vertically aligned with the upwardly facing lower surface of trough-like portion 112 of rail 95 for a purpose discussed further below. It will be appreciated that once connector 120 is mounted on rail 95, the forwardmost vertical edges 140 of front plate-like member 121 are located behind the rearwardly facing surfaces of the respective wall parts 100, 107 and 110 of rail 95, so that lower channel 109 of rail 95 is not blocked from the end. Further, the recess 133 of connector 120 is aligned with upper channel 108 of rail 95 so that channel 108 is also not blocked from the end. The right connector 120 is assembled onto the opposite end of mounting rail 95 in a similar manner.

The rail 95 is mounted to the respective wall panel assembly 11 by positioning rail 95 in a tilted orientation and inserting upper hooks 130 of the right and left connectors 120 into corresponding apertures 30 located at the lower ends of the respective adjacent support posts 23. The upper edges of the posts 23 which define the uppermost extent of the respective apertures 30 are engaged within the respective recesses 133 of upper hooks 130 and serve to define a horizontal pivot axis about which the rail 95 is then tilted downwardly so as to align lower hooks 131 with the corresponding lower apertures 30. The lower edge of rail 95 is then pivoted toward the posts 23 to engage lower hooks 131 in the respective apertures 30, and the entire rail 95 is then lowered so as to allow the lower edges of the posts 23 which define the lowermost extents of the respective apertures 30 to engage within the respective slots 134 and 135 of connectors 120. Additional rails 95 are attached to adjacent wall panel assemblies 11 so that the respective upper and lower channels 108 and 109 of serially adjacent rails 95 define continuous elongate channels which extend across the lower extent of the panel run.

Once the interior framework and components of the wall panel assembly 11 are assembled as discussed above, lower cover pads 141 (FIGS. 2 and 3) are connected to the respective base panel assembly 12 so as to define an outer finished surface which overlies the respective base panel assembly 12. More specifically, the upper horizontal rail 33 of base panel 12 mounts thereon a plurality of pad brackets 142 similar to pad brackets 67 discussed above, which brackets 142 engage in recesses defined along the upper horizontal edge of pad 141. The lowermost edge of cover pad 141 is then pivoted toward rail 95 and is seated within the channel 116 thereof. The shorter front flange 113 of rail 95 assists in insertion of pad 141 into channel 116. In this regard, the pad-supporting flanges 124 of connectors 120 support the respective lowermost corners of cover pad 141, with the first horizontal leg 125 abutting against the lower surface of pad 141, and the second vertical leg 126 overlying the sidewardly-facing vertical edge surface of pad 141.

Figure 14:
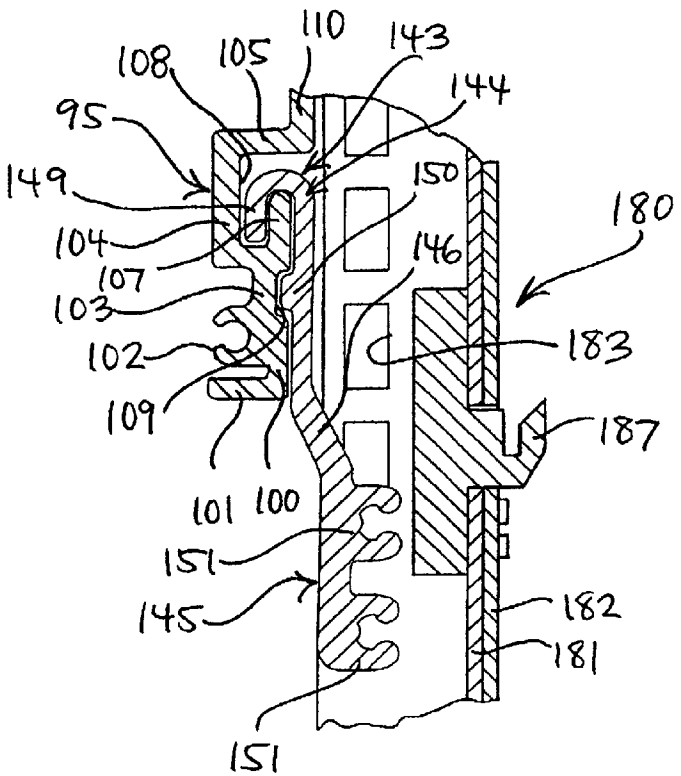
FIG. 14 is an enlarged fragmentary cross-sectional view of the bottom mounting bracket and its engagement with the lower mounting rail taken generally along line 14—14 in FIG. 10.
Figure 13:
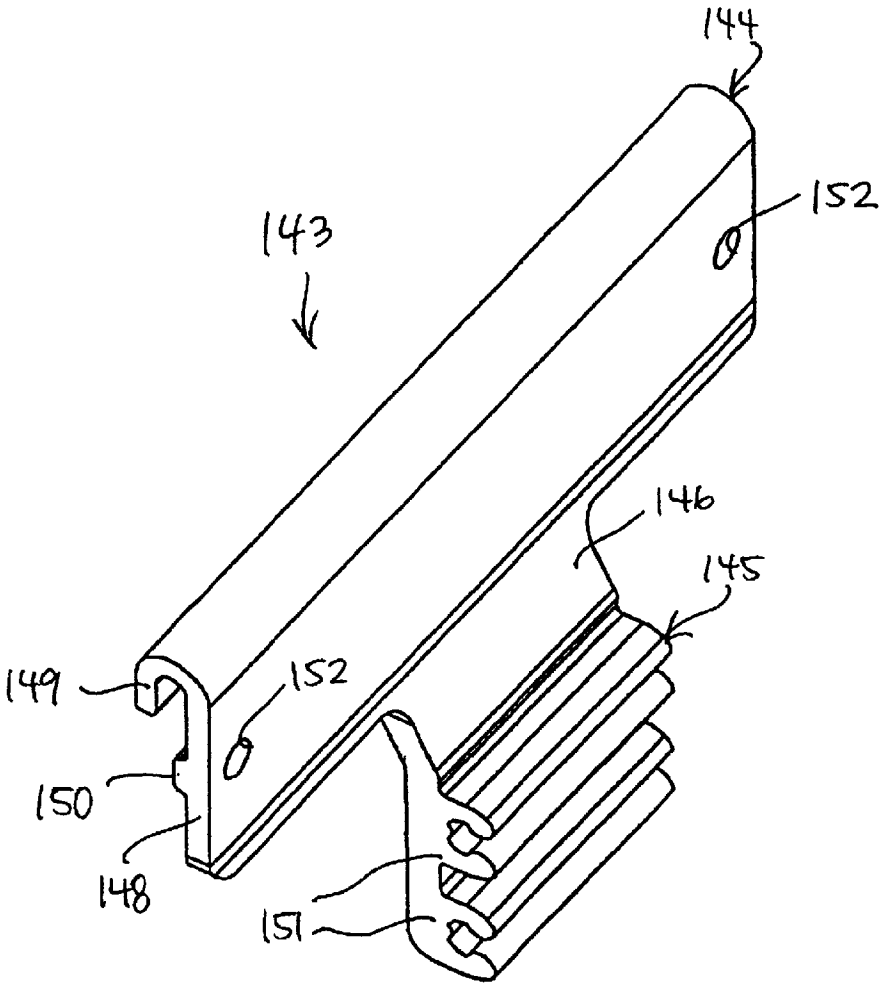
FIG. 13 is an enlarged perspective view of the bottom mounting bracket.

With reference to FIGS. 13 and 14, a bottom bracket 143 is provided which cooperates with mounting rail 95. More specifically, bottom bracket 143 includes an upper hook-shaped section 144 and a lower post-mounting section 145 which projects forwardly from hook-shaped section 144 by way of an angled portion 146. Upper section 144 includes an upright wall part 148 which defines thereon a downwardly projecting hook 149 at an upper end thereof and a rearwardly projecting rib 150 which is spaced vertically downwardly from hook 149. Post-mounting section 145 defines a pair of forwardly projecting and sidewardly-opening mounting bosses 151 disposed in vertically spaced relation with one another. A pair of mounting holes 152 are provided adjacent opposite vertical side edges of wall part 148.

Figure 10:
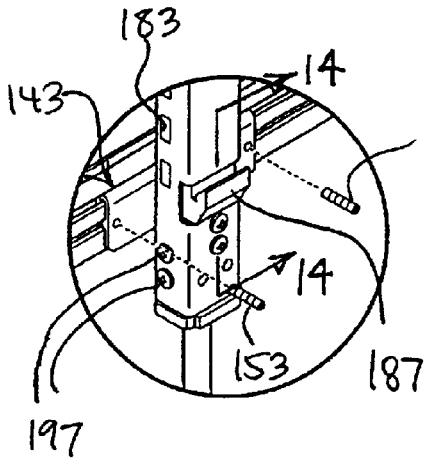
FIG. 10 is an enlarged detail view of the lower end of the return-wall connector post and bottom mounting bracket shown in FIG. 8.

As shown in FIGS. 10 and 14, bottom bracket 143 is mounted on rail 95 by positioning bracket 143 alongside a terminal end of mounting rail 95 located at a free end of a panel run, and inserting the hook 149 sidewardly into upper channel 108 of rail 95 and rib 150 sidewardly into lower channel 109. The hook 149 thus engages the front wall part 107 of rail 95 and supports the bracket 143 thereon. The bracket 143 is then positioned at the desired location by sliding same longitudinally along rail 95. Fasteners 153 are then inserted into mounting holes 152 of bottom bracket 143 to fix same at the desired location.

A top cap 154 according to the invention is illustrated in FIGS. 2 and 4. Top cap 154 is of a rigid construction, and in the illustrated embodiment is an extruded metal part having significant load-bearing capabilities. More specifically, top cap 154 is elongate and includes an upper wall 155 which, when viewed in transverse cross-section as in FIG. 4, has an slightly upwardly convex curvature. The upper wall 155 defines therein an upwardly-opening elongate groove or channel 156 which extends continuously along the entire lengthwise extent of top cap 154 and opens sidewardly at the opposite ends thereof. Groove 156 has an inverted T-shaped configuration, the mouth 157 of which is defined by inner opposed edges 158 of upper wall 155, a pair of vertically short upright walls 159 which are spaced slightly outwardly from the respective opposed edges 158 and project downwardly from a lower surface of upper wall 155, and a bottom wall 160 which is generally horizontally oriented and joined to lower edges of the respective walls 159.

Top cap 154 additionally includes a pair of generally rounded elongate side edges 161 which are joined to opposite longitudinal edges of upper wall 155, and a pair of intermediate and generally horizontally oriented wall sections 162 joined to lower edges of side edges 161. A pair of upright wall portions 163 project generally downwardly from wall sections 162 and are joined to respective inclined wall parts 164 which angle downwardly as same project inwardly. The inner ends of inclined wall parts 164 are joined to respective horizontally oriented support walls 165, each of which defines a downwardly facing support surface thereon.

A lowermost and generally horizontally oriented bottom wall 167 is joined to and extends between the respective support walls 165, and a pair of L-shaped mounting flanges 168 project downwardly from a lower surface of bottom wall 167. More specifically, each mounting flange 168 is defined by an upright leg 169 which projects downwardly from bottom wall 167, and a horizontal leg 170 which is joined to a lower end of upright leg 169 and projects outwardly for termination approximately at the junction of the adjacent support wall 165 and bottom wall 167. The mounting flanges 168, along with bottom wall 167, define respective channels 171 which open sidewardly toward opposite sides of top cap member 154. The wall structure of top cap 154 as described above provides same with a hollow interior 172.

To provide a finished appearance to the upright side edges of the endmost wall panel assembly 11, vertically elongate trim covers 173 are assembled to the end faces of the respective support posts 23. In this regard, each trim cover 173 is provided with clips (not shown) which cooperate with corresponding ones of the openings 31 in the respective support post 23 to secure the trim covers 173 thereto. As shown in FIG. 2, the open end of the top cap member 154 located adjacent the endmost upright side edge of the panel assembly 11 is provided with an end cap 174 which is configured to engage within the open upper end of the trim cover 173.

Referring to FIGS. 2 and 4, top cap 154 is mounted uppermost cross member 22 via pad brackets 67 and top cap clips 83. More specifically, in the preferred embodiment, top cap 154 is manufactured in predetermined lengths, and is then cut in the field to the appropriate length, depending upon the particular panel configuration. Once top cap 154 is cut to the desired length, end cap 174 is assembled onto the free end of top cap 154. Top cap 154 is then positioned above the cross member 22 with the end cap 174 aligned with the open upper end of trim cover 173, and the fasteners 94 of the respective clips 83 are loosened so that the respective pairs of clamp members 84 are moved away from one another to allow engagement of the lower mounting flanges 168 of top cap 154 within the respective sidewardly opening channels 92 of the opposed pairs of clamp members 84. The fasteners 94 of clips 83 are then tightened once again so that the respective pairs of clamp members 84 move toward one another and clampingly engage the lower flanges 168 of top cap member 154 and fix same to cross member 22 (FIG. 4). As shown in FIG. 12, once clips 83 are engaged with top cap member 154, same is additionally supported on the upper support flanges 76 of the respective pad brackets 67. More specifically, the upper surfaces of support flanges 76 supportingly engage the respective lower surfaces of support walls 165 of top cap member 154, with the mounting flanges 168 thereof projecting downwardly between the upwardly projecting walls 75 of pad brackets 67.

Additional top cap members 154 are then mounted along the remainder of the panel run. It will be appreciated that the number of clips 83 utilized will depend upon the length of top cap member 154, and in the illustrated embodiment, two clips 83 are provided with each clip 83 being positioned between an adjacent pair of brackets 67. The grooves 156 of the longitudinally adjacent top cap members 154 are aligned with one another so as to define a continuous elongate groove along the length of the panel run.

Additional upper cover pads or stack pads 175 are then attached above the respective base panel assemblies 12 so as to define a continuous outer finished surface of the wall panel assemblies 11. The uppermost edges of cover pads 175 are secured to frame structure 28 via the pad brackets 67 located along lower cross member 22, via recesses which cooperate with the downwardly projecting flanges 72 of brackets 67. Each cover pad 175 mounts thereon a hook structure (not shown) adjacent each lower side edge thereof which engage within the correspondingly located apertures 30 of the respective adjacent pair of support posts 23. The mounting of upper cover pads 175 on the wall panel assembly 11 is discussed in the '258 patent, and will therefore not be discussed in detail here.

As shown in FIG. 1, a plurality of wall panel assemblies 11 can be assembled as discussed above so as to define one or more workstations. When a three or four-panel configuration is desired or necessary, the additional transverse wall panels are typically joined to an assembled panel run at the location of a support post 23 with an appropriate connector arrangement. However, due to limited space or simply in order to tailor a particular workstation to an individual's needs, it is often necessary to be able to mount a panel assembly or return wall to the existing panel run at a location intermediate a respective pair of support posts 23, which in the industry is sometimes referred to as "off-module" mounting. For this purpose, the wall panel arrangement 10 according to the invention includes a return wall connector post 180 which is illustrated in FIGS. 8–11.

Connector post 180 is of a rigid double-wall construction defined by inner and outer generally U-shaped channel members 181 and 182 which are nested together so that post 180 opens rearwardly (FIG. 11). Like support posts 23, the post 180 defines a plurality of vertically spaced accessory-mounting apertures 183 in opposite facing sides of post 180, and additionally defines a plurality of panel-mounting openings 184 in the outwardly-facing or front side thereof. Post 180 also includes an extension rod 185 in threaded engagement with a disc-like glide 186 in supportive engagement with the floor. The lowermost end of post 180 mounts thereon a connector hook 187 similar to connector hooks 27 which faces outwardly. The uppermost end of post 180 mounts thereon a connecting plate 188. In the illustrated embodiment, connecting plate 188 is integrally formed with the outermost channel member 182 and is cantilevered forwardly from the upper edge thereof and defines the uppermost extent of post 180. As shown in FIG. 11, connecting plate 188 defines a pair of mounting holes 189 therein.

Figure 9:
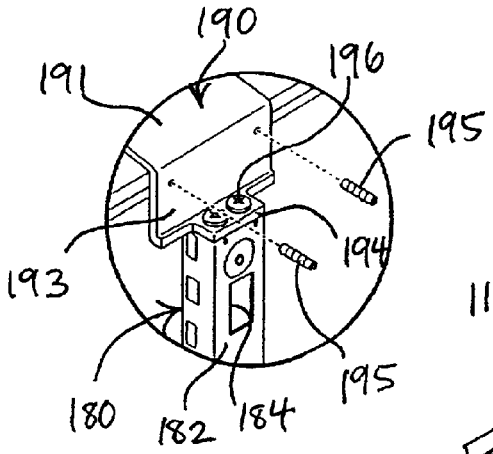
FIG. 9 is an enlarged detail view of the upper end of the return-wall connector post and top mounting bracket shown in FIG. 8.
Figure 8:
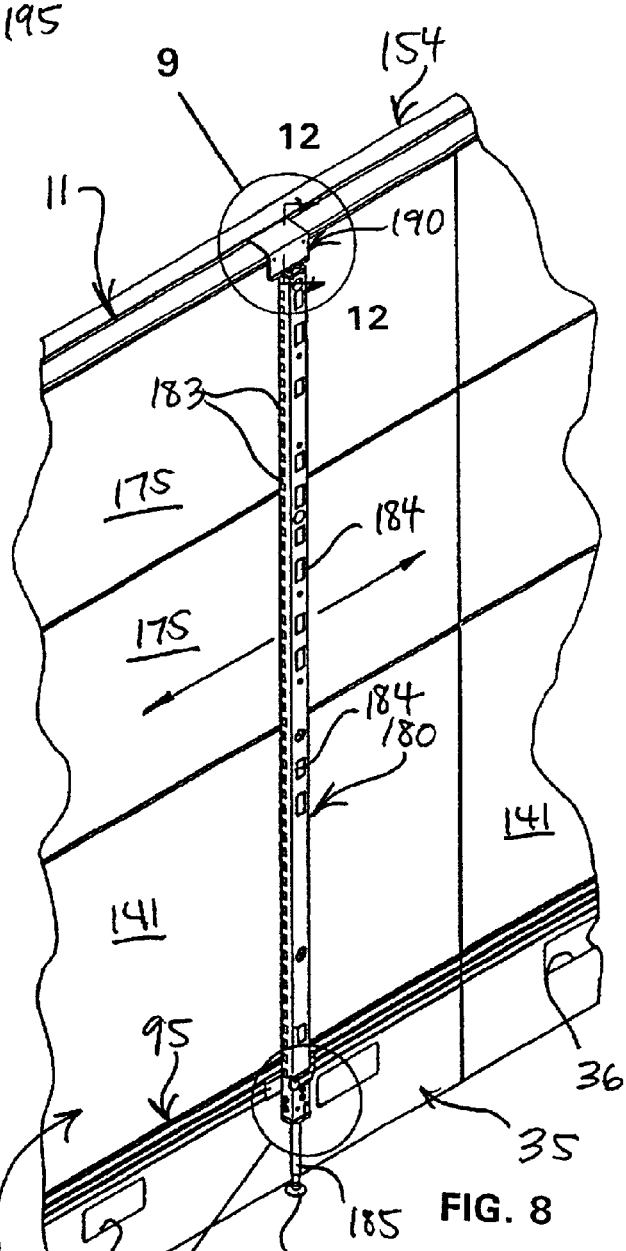
FIG. 8 is a fragmentary perspective view of a pair of serially adjacent wall panel assemblies of FIG. 1 and a return-wall connector post utilized to form a T-shaped panel configuration.

As shown in FIGS. 8, 9 and 12, a top bracket 190 is provided for mounting the upper end of post 180 to a wall panel assembly 11. Top bracket 190 is defined by a top wall 191 having a contour similar to the contour of upper wall 155 of top cap member 154. The innermost free edge of top wall 191 defines a downwardly projecting hook structure 192 which is configured for engagement within the groove 156 of top cap member 154. The outermost edge of top wall 191 is joined to a straight and downwardly projecting wall 193 which is generally perpendicular relative to top wall 191. Wall 193 is joined to a lower mounting flange 194 oriented at an approximately right angle relative to wall 193.

Top bracket 190 is mounted to the top cap 154 by positioning the bracket 190 in an upwardly inclined position relative to top cap 154 with hook structure 192 disposed lowermost, inserting hook structure 192 downwardly into groove 156, and then rotating bracket 190 downwardly so that hook structure 192 engages around the edge 158 of top cap upper wall 155 and wall 193 overlies the side edge 161 of top cap 154 and the outer side surface of the uppermost cover pad 175.

With reference to FIG. 8, post 180 is mounted to a selected wall panel assembly 11 as follows. Top bracket 190 is moved longitudinally along top cap 154 to a position which corresponds to the desired location of a return panel. Similarly, bottom bracket 143 is moved longitudinally along mounting rail 95 so that the post-mounting section 145 thereof is generally vertically aligned with bracket 190. Post 180 is then positioned adjacent the brackets 190 and 143 with the open side thereof facing the wall panel assembly, so that connector plate 188 is positioned beneath lower mounting flange 194 of bracket 190, and also so that post-mounting section 145 projects forwardly into the lower end of post 180 through the open rear side thereof (FIG. 14). The upper end of post 180 is secured to top bracket 190 by inserting fasteners 196 through holes in lower mounting flange 194 and into the holes 189 defined in upper connector plate 188 of post 180. The lower end of post 180 is secured to bottom bracket 143 by inserting fasteners 197 (only two of which are shown in FIG. 10) into corresponding holes defined on opposite sides of post 180 (i.e. the sides defining the accessory-mounting apertures 183) and into the bosses 151 of post-mounting section 145.

As shown in FIGS. 9 and 10, in order to fixedly position brackets 190 and 143 relative to top cap 154 and mounting rail 95, respectively, fasteners 195 are inserted into corresponding mounting holes defined in wall 193 of bracket 190 so as to engage side edge 161 of top cap 154, and fasteners 153 are inserted into holes 152 of bracket 143 so as to engage rail 95.

With the post 180 now fixedly mounted to the selected panel assembly 11, a return wall or panel 198 is then mounted to the outwardly facing side of post 180 via panel locks (not shown) which engage within the openings 184 and via the connector hook 187 at the lower end of post 180 in a similar manner as disclosed in the '485 patent.

In addition to providing a return panel 198 in a location which does not correspond to the location of support posts 23, it is often necessary or desirable to mount furniture components or accessories, such as an overhead storage cabinet 14 or shelf 15, in locations which are not dependent upon the location of posts 23 and the associated accessory-mounting apertures 30. More specifically, FIG. 1 illustrates off-module mounting of storage cabinet 14 and shelf 15 in locations between respective adjacent pairs of support posts 23. Cabinet 14 and shelf 15 are mounted to the wall panel arrangement 10 with respective pairs of hanger-type mounting brackets 201. The brackets 201 are identical to one another, and only one of which will therefore be described here.

Figure 16:
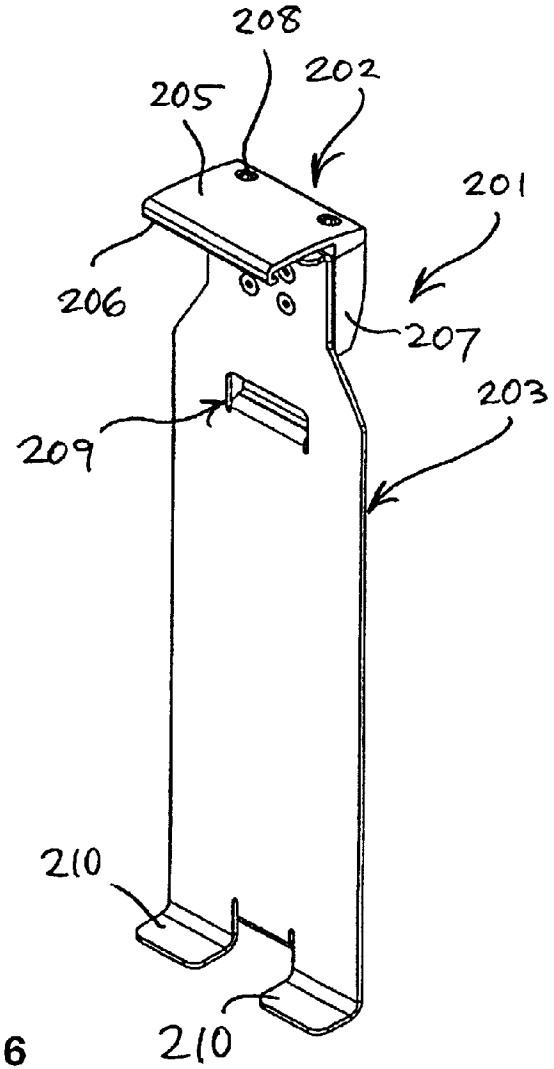
FIG. 16 is an enlarged rear perspective view of the bracket shown in FIG. 15.
Figure 15:
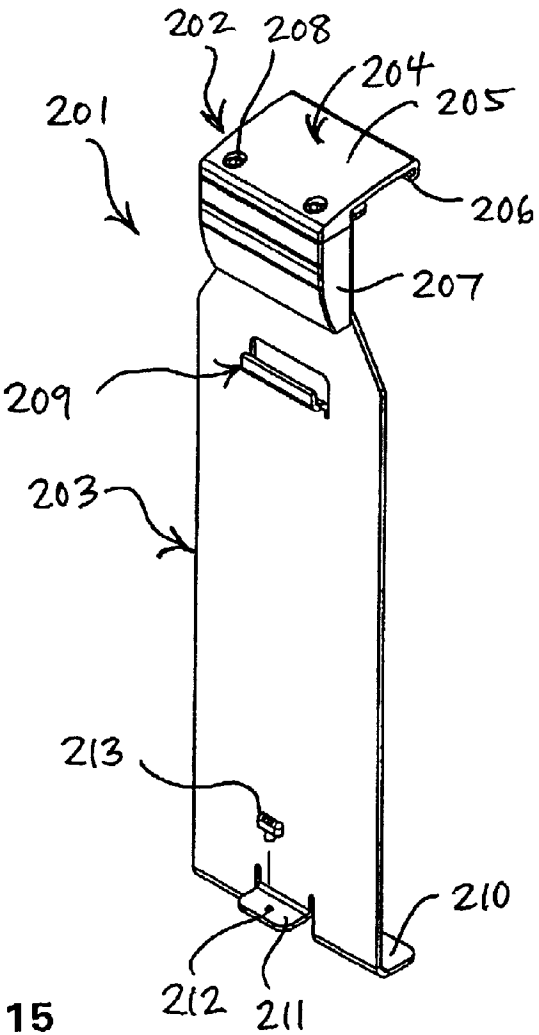
FIG. 15 is an enlarged front perspective view of one component-mounting bracket.

With reference to FIGS. 15 and 16, bracket 201 includes an upper corner-shaped mounting structure 202 which is fixed to an elongate and downwardly-depending, rigid and plate-like support member 203. Mounting structure 202 includes an upper mounting element 204 which is similar in configuration to top wall 191 of top bracket 190. That is, mounting element 204 includes an upper wall 205 which has a similar contour as upper wall 155 of top cap 154, and includes a hook element 206 which defines the innermost free edge thereof. Mounting structure 202 additionally includes a lower mounting element 207 which is attached to upper mounting element 204 via fasteners 208 and which is fixed to an upper end of plate-like support member 203 by rivets or other suitable fasteners.

Plate-like support member 203 at an upper end thereof defines an outwardly projecting L-shaped tab 209 formed from a cut-out portion of support member 203 which is then bent to form the L-shape of tab 209. The lower end of support member 203 includes a pair of rearwardly projecting tabs 210 which are horizontally spaced from one another and oriented in the same horizontal plane, and a forwardly projecting tab 211 which is located horizontally between tabs 210 and is spaced vertically upwardly therefrom. Forwardly projecting tab 211 is generally parallel to tabs 210. Further, tab 211, as shown in FIG. 15, defines therein a through-hole 212 which receives a locking clip 213.

Referring now to FIG. 17, same illustrates the rear portion of storage cabinet 14 and its cooperation with a mounting bracket 201. The storage cabinet 14 as shown in FIGS. 1 and 17 is similar to the cabinet disclosed in U.S. Pat. No. 5,845,980, which is owned by the same Assignee hereof and hereby incorporated by reference herein. The cabinet 14 will therefore be only briefly described herein with regard to its cooperation with mounting brackets 201. Storage cabinet 14 includes an upright rear wall 214 which is appropriately bent to define a rearwardly opening L-shaped guide channel 215 which extends longitudinally across the rear face of cabinet 14. The mouth 216 of guide channel 215 is defined by the lowermost edge of a downwardly projecting portion 217 of rear wall 214 and the rearmost edge of a lower horizontal portion 217 of rear wall 214. Rear wall 214 is additionally bent at a lower end thereof to form a bottom flange 218 which is generally horizontally oriented and projects forwardly for connection to a bottom shelf wall 219 of cabinet 14.

With reference to FIG. 17, the storage cabinet 14 is mounted to a selected wall panel assembly 11 as follows. The upper mounting element 204 of a bracket 201 is first attached to top cap member 154 in the same manner as top bracket 190 so that hook element 206 thereof engages within groove 156 of top cap member 154. Upper mounting element 204 is then attached to lower mounting element 207 (which is already securely mounted to plate-like support member 203) with fasteners 208, and the lower end of support member 203 is moved toward wall panel assembly 11 to insert rearwardly projecting tabs 210 between the lowermost and uppermost terminal edges of the uppermost and intermediate cover pads 175, respectively. The terminal free ends of tabs 210 engage within a corresponding groove 65 of support rail 61 (see FIG. 18). An additional bracket 201 is then attached to the wall panel assembly 11 sidewardly adjacent the first bracket 201 in a similar manner. The brackets 201 are positioned at the desired locations longitudinally along wall panel assembly 11 by sliding same within groove 156 of top cap member 154 and within groove 65 of rail 61.

The storage cabinet 14 is thereafter positioned so that the rear side thereof faces brackets 201, and the upper tabs 209 of the respective brackets 201 are inserted into the channel 215 of cabinet 199 so as to engage portion 217 of rear wall 214. The bottom flange 218 of cabinet 14 is then seated on the upwardly facing surface of tabs 211 of brackets 201, and locking clips 213 are inserted into holes 212 of tabs 211 and then into corresponding slots 220 defined in bottom wall 218.

The shelf 15 has a similar rear wall configuration as storage cabinet 14, and is attached to brackets 201 and wall panel assembly 11 in a manner similar to that described above with regard to cabinet 199.

With reference to FIG. 1, the storage cabinet 14 and shelf 15 are positionable at virtually any location along the longitudinal extent of wall panel assembly 11, and the locations and dimensions thereof are not dictated by the locations of the adjacent pairs of support posts 23. Likewise, the return wall connector post 180 is positionable at virtually any location between respective pairs of connector posts 23. This arrangement thus permits greater flexibility in configuring a workstation.

It will be appreciated that the wall panel system 10 according to the invention allows ready reconfiguration of a workstation. For example, the return wall 198 can be repositioned simply by loosening fasteners 195 of top bracket 190 and fasteners 153 of bottom bracket 143 and sliding return wall 198 to the desired position, for example using panel skates which support the lower end of the return wall 198 and allow sliding thereof across the floor. Similarly, the storage cabinet 14 and shelf 15 can be repositioned along the respective panel assembly 11 by removing the cabinet or shelf from the respective brackets 201, repositioning the brackets 201 at the desired location by sliding same along the wall panel assembly 11, and then reattaching the cabinet or shelf.

It will also be appreciated that the structural rigidity of top cap member 154 according to the invention and its cooperation with the frame structure 28 of the wall panel assembly 11 and the respective brackets 190 and 201 is capable of supporting significant loads. More specifically, the top cap 154 is securely, but removably, attached to upper cross member 22 via clips 83 which engage opposite sides of upper cross member 22. Top cap 154 is thus capable of withstanding significant twisting loads from the side which result from the mounting of furniture components thereon. In addition, the brackets 201 are attached at the upper ends thereof to top cap 154 via groove 156, and the lower ends additionally engage or abut a rigid frame member, or support rail 61.

Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. A space-dividing wall panel assembly comprising:

an open frame defined by a pair of upright and laterally-spaced vertically elongate support members, and a plurality of vertically spaced and discrete cross members extending laterally between said support members and rigidly connecting said support members to one another;

a pair of cover members disposed in opposed relation with one another so as to overlie open areas of said frame between said support members, said cover members defining vertical side surfaces of said wall panel assembly;

an elongate top cap positioned longitudinally along an upper one of said cross members and extending along a substantial portion of the longitudinal extent of said upper cross member, said top cap having an upper portion which defines therein a longitudinally extending and outwardly opening groove and a lower portion which projects downwardly between upper edges of the opposed cover members for removable securement to said upper cross member, said lower portion defining first and second flanges which project outwardly towards opposite sides of said panel assembly;

a mounting member engaging said lower portion of said top cap and including a pair of separate clamps disposed in opposed relation with one another and clampingly engaging said upper cross member from opposite outwardly facing sides thereof, said clamps defining respective channels which open inwardly and toward one another and in which said first and second flanges are engaged; and a bracket slidably engaged within said groove of said top cap.

2. The wall panel assembly of claim 1 wherein said groove is T-shaped in transverse cross section.

3. The wall panel assembly of claim 1 wherein an upper end of said bracket is engaged within said groove and said bracket has a lower end in supportive engagement with a lower one of said cross members, said bracket overlying a portion of said vertical side surface of a respective cover member and mounting thereon a furniture component, and said vertical side surfaces define respective outer side surfaces of said wall panel assembly.

4. The wall panel assembly of claim 1 wherein an elongate fastener extends through each said clamp and is adjustable to move said clamps toward one another to fixedly secure said top cap to said upper cross member, and away from one another to release said top cap from said upper cross member.

5. The wall panel assembly of claim 1 wherein said upper portion of said top cap defines a generally hollow interior, and said lower portion projects downwardly from a bottom wall of said upper portion for engagement with said upper cross member.

6. The wall panel assembly of claim 1 further including a furniture component mounted on said bracket.

7. The wall panel assembly of claim 1 wherein said bracket is an upper bracket and said panel assembly further includes a lower elongate mounting rail secured to said panel assembly along a lower edge thereof and defining a longitudinally extending and sidewardly opening groove therein, a lower bracket slidably engaged within said groove of said mounting rail, and a connector post having an upper end secured to said upper bracket and a lower end connected to said lower bracket for mounting a return wall in transverse relation to said wall panel assembly.

8. The wall panel assembly of claim 1 wherein said mounting member is a separate and distinct component from said top cap.

9. The wall panel arrangement of claim 6 wherein said furniture component is an overhead storage unit.

10. The wall panel assembly of claim 1 wherein said bracket is slidably movable longitudinally along said panel assembly.

11. In a wall panel arrangement having a frame defined by a plurality of upright and laterally spaced posts which are interconnected to one another by transversely extending and discrete frame members which are vertically spaced-apart from one another, said wall panel arrangement further including a plurality of cover members mounted on said frame between adjacent pairs of said posts and defining vertically oriented side surfaces, and an elongate top cap extending along an upper longitudinal edge of said frame, comprising the improvement wherein said top cap is removably mounted to an upper one of said frame members by a mounting member which engages a lower portion of said top cap and clampingly engages said upper frame member from opposite sides thereof, said mounting member also engaging a lower surface of said upper frame member, said top cap defining a longitudinal groove therein which opens upwardly, and a hanger having an upper end slidably engaged within said groove of said top cap and being suspendingly supported therefrom, said hanger overlying an outer surface of one of said cover members and mounting a furniture component thereon.

12. The wall panel arrangement of claim 11 wherein said groove of said top cap has an inverted T-shaped cross section and opens upwardly through an uppermost wall of said top cap.

13. The wall panel arrangement of claim 12 wherein said lower portion of said top cap defines a pair of mounting flanges which engage within respective channels defined within said mounting member.

14. The wall panel arrangement of claim 11 wherein said mounting member includes a pair of clamps disposed in opposed relation with one another, each said clamp having a lower portion including an upright wall part which overlies an upright side wall of said upper frame member and a lower flange which projects inwardly and horizontally from a lower edge of said wall part and engages said lower surface of said upper frame member, and an upper portion defining an inwardly opening and horizontally extending recess in which said lower portion of said top cap engages, said clamps being adjustable relative to one another in a first direction wherein said clamps are movable toward one another and into engagement with said top cap, and a second direction wherein said clamps are movable away from one another so as to disengage from said top cap and permit removal of same.

15. The wall panel arrangement of claim 11 wherein said top cap has an upper portion defining said groove therein, said upper portion includes a wall structure which defines a hollow interior, and said lower portion includes a pair of mounting flanges which project downwardly from a bottom wall of said upper portion and engage within respective channels defined within said mounting member.

16. The wall panel arrangement of claim 11 wherein said mounting member is a separate and distinct component from said top cap.

17. The wall panel arrangement of claim 11 wherein said top cap extends along a substantial portion of the longitudinal extent of said upper frame member.

18. An upright space-dividing wall panel assembly comprising a pair of horizontally spaced, elongate and generally vertically oriented supports and an elongate and generally horizontally oriented rail member extending between said supports, a pair of generally vertically oriented and planar side surfaces on respective oppositely facing sides of said panel assembly, an elongate and rigid one-piece top cap which is generally horizontally oriented and positioned above and extending along a substantial portion of said rail member, a mounting structure clampingly engaging opposite sides of both said top cap and said rail member to fixedly secure said top cap thereto, said mounting structure being defined by a pair of opposed and generally C-shaped clamps, said C-shaped clamps overlying said C-shaped clamps overlying respective opposite sides of the rail member and having respective upper portions which interlock with a lower portion of said top cap, said clamps being adjustably fastened to one another to allow same to move toward one another into clamping engagement with said top cap and said rail member, and away from one another to permit release of said clamps from said top cap and said rail member and allow removal of said top cap from said panel assembly and having respective upper portions which interlock with a lower portion of said top cap, said top cap having an uppermost wall defining therein an elongate and continuous groove which opens upwardly through said uppermost wall for accommodating therein a mounting element which projects downwardly into said groove and is associated with a furniture component mounted on said panel assembly, said groove transferring at least a portion of an external downward load associated with the furniture component from said top cap to said rail member.

19. The wall panel assembly of claim 18 wherein one of said lower portion of said top cap and said upper portions of said C-shaped clamps defines a recess therein and the other of said lower portion and said upper portions defines a flange thereon which projects into said recess to secure said top cap to said mounting structure.

20. The wall panel assembly of claim 18 wherein said lower portion of said top cap defines thereon a pair of horizontally sidewardly projecting cantilevered flanges which engage within inwardly opening and horizontally-oriented recesses defined in the respective upper portions of said clamps.

21. The wall panel assembly of claim 18 wherein said mounting structure includes a plurality of said pairs of said C-shape clamps, said C-shaped clamps of each said pair being detachable and separate from one another and being disposed in opposed relation with one another, said pairs of said C-shaped clamps being separate components from said top cap and being spaced longitudinally from one another along said rail member.

22. The wall panel assembly of claim 18 wherein said groove is generally centrally located between two parallel and longitudinally extending edges of said uppermost wall, said groove having a transverse cross section defined by a lower horizontally oriented portion and an upper vertically oriented portion which defines a mouth of said groove and which has a transverse width substantially less than a transverse width of said lower portion, said upper portion projecting upwardly from said lower portion in generally perpendicular relation therewith to provide said groove with an inverted T-shaped cross section.

23. A space-dividing wall panel arrangement comprising a rigid open frame defined by a plurality of laterally-spaced uprights having lower ends disposed in supportive engagement with a horizontal support surface and a plurality of vertically-spaced supports extending transversely between and rigidly interconnecting said uprights, a pair of covers disposed on opposite open sides of said frame and defining respective generally vertically oriented side surfaces of said panel arrangement, a rigid and elongate top cap supported on an upper one of said supports and extending along a substantial portion thereof, said top cap defining therein an upwardly-opening, elongate and continuous channel for mounting therein a hanger associated with a furniture accessory positioned for supportive engagement with said panel arrangement, and a plurality of discrete brackets spaced-apart longitudinally along said panel arrangement, each said bracket being defined by a pair of clamps which are detachable from one another and disposed in opposed relation with one another on opposite sides of said upper support and which clampingly and rigidly secure said top cap to said upper support to permit external loads associated with furniture accessories, to be transferred from said top cap to said upper support.

24. The wall panel arrangement of claim 23 wherein said channel is defined entirely by said top cap.

25. The wall panel arrangement of claim 23 wherein said uprights and said supports are rigid members constructed of metal.

26. The wall panel arrangement of claim 23 wherein said clamps defining each said bracket are identical and are adjustably fastened to one another so as to permit said clamps to move toward and away from one another, each said clamp having a lower C-shaped portion which overlies an upright side wall of said upper support and an upper portion fixed to the respective lower portion and defining therein a sidewardly and inwardly opening channel, said top cap having an upper portion defining said continuous channel therein and a lower portion mounting thereon a pair of sidewardly projecting and cantilevered flanges which respectively engage within said channels of said clamps.

27. The wall panel arrangement of claim 26 wherein said flanges of said top cap extend along substantially the entire longitudinal extent thereof.

28. A space-dividing wall panel arrangement including a plurality of sidewardly spaced and vertically oriented support posts, each adjacent pair of said posts being interconnected to one another by a plurality of horizontally oriented, vertically spaced and discrete cross members so as to define an open frame, a pair of oppositely facing and vertically oriented panels supported on said frame and defining respective opposite sides of said panel arrangement, a top cap extending along and supported by an upper one of said cross members, said top cap being secured to said upper cross member by a plurality of clamping members which are spaced-apart longitudinally along said panel arrangement, each said clamping member being of two-piece construction defined by a pair of adjustably fastened clamps which are detachable from one another and are disposed on respective opposite sides of said upper cross member, said top cap defining an elongate mounting element spaced downwardly from said groove which engages with upper portions of the respective pairs of opposed clamps to secure said top cap thereto, said top cap defining therein a groove which extends continuously along an upper extent of said panel arrangement and which seats therein an upper end portion of a hanger which supports an office furniture accessory to mount same in a suspended manner on said panel arrangement at a selected location therealong, said hanger having a lower end portion disposed in direct load-bearing engagement with a lower one of said cross members.

29. The wall panel arrangement of claim 28 wherein said groove opens upwardly and is defined solely by said top cap.

30. The wall panel arrangement of claim 28 wherein said hanger projects downwardly over an outwardly-facing side surface of one of said panels, and said lower end portion of said hanger is positioned adjacent and disposed in direct load-bearing relationship with said lower cross member.

31. The wall panel arrangement of claim 28 wherein one of said panels comprises a pair of panels supported on one side of said frame, each said panel being defined by spaced-apart and generally upright opposite edges and upper and lower edges extending laterally between said opposite edges, said upper end portion of said hanger has a hook shape and is slidably engaged within said groove and said lower end portion defines a flange thereon, said flange projecting inwardly between said lower edge of an upper one of said panels and said upper edge of a lower one of said panels and supportingly engaging said lower one of said cross members.

32. The wall panel arrangement of claim 31 said flange is a first flange, and said hanger further includes a sidewardly projecting tab which engages within a recess defined in a rear wall of said accessory, and a second flange which projects outwardly and is disposed in supportive engagement with a lower wall of said accessory.

33. The wall panel arrangement of claim 32 wherein said accessory is an overhead storage unit.

34. A space-dividing wall panel assembly comprising an open frame defined by a pair of vertically oriented uprights fixed to one another by at least one horizontally oriented cross rail which extends transversely between said uprights, a pair of opposed side covers overlying said frame on opposite sides thereof, an elongate top cap positioned above said cross rail and secured thereto by a plurality of discrete clamps which are separate and distinct components from said top cap and are spaced longitudinally along said cross rail, said top cap defining an elongate channel therein for accommodating a mounting element associated with a furniture component supported on said panel assembly, said clamps being releasably engaged with said top cap and said cross rail to allow removal of said top cap from said panel assembly, each said clamp being defined by a pair of opposed and discrete brackets which are adjustably fastened to one another and sandwich therebetween both said cross rail and a lower portion of said top cap, and said top cap having a width dimension which is greater than a width of said frame such that said top cap spans a width of said panel assembly as defined between said opposed side covers.

35. The wall panel assembly of claim 34 wherein said mounting element is an upper mounting element, and said assembly further includes a lower mounting element fixed to a lower portion of said panel assembly and an elongate and upright connector post having an upper end portion secured to said upper mounting element and a lower end portion secured to said lower mounting element, and a return wall fixed to said connector post so as to extend in transverse relation to one of said side covers.

36. The wall panel assembly of claim 34 wherein said mounting element supports an overhead storage unit which overlies an exterior portion of one of said side covers.

37. A space-dividing wall panel assembly comprising a frame defined by a pair of upright and laterally spaced vertically elongate support members and a cross member extending laterally between said support members, a pair of generally vertically oriented side surfaces on respective oppositely facing sides of said panel assembly, an elongate top cap positioned longitudinally along said cross member, said top cap defining therein a longitudinally extending and outwardly opening groove, a pair of opposed clamps engaging a lower portion of said top cap and clampingly engaging said cross member from oppositely facing sides thereof, an elongate fastener extending through the respective clamps and being adjustable to move said clamps toward one another to fixedly secure said top cap to said cross member, and away from one another to release said top cap from said cross member.

* * * * *

UNITED STATES PATENT AND TRADEMARK OFFICE

CERTIFICATE OF CORRECTION

PATENT NO. : 6,920,727 B2
DATED : July 26, 2005
INVENTOR(S) : X. Shawn Yu et al.

It is certified that error appears in the above-identified patent and that said Letters Patent is hereby corrected as shown below:

Column 18,
Lines 16-17, delete second occurrence of “said C-shaped clamps overlying.”.

Column 20,
Line 21, add -- wherein -- after “claim 31.”.

Signed and Sealed this

Twentieth Day of December, 2005

JON W. DUDAS
*Director of the United States Patent and Trademark Office*